US008544457B1

(12) United States Patent
Munsell et al.

(10) Patent No.: US 8,544,457 B1
(45) Date of Patent: Oct. 1, 2013

(54) ARCHERY REST SYSTEM

(75) Inventors: Andrew Munsell, Brighton, CO (US); Timothy J Gillingham, Provo, UT (US); Shawn A. Greathouse, Johnstown, CO (US)

(73) Assignee: Hamskea Archery Solutions, LLC, Johnstown, CO (US)

( * ) Notice: Subject to any disclaimer, the term of this patent is extended or adjusted under 35 U.S.C. 154(b) by 182 days.

(21) Appl. No.: 13/334,167

(22) Filed: Dec. 22, 2011

Related U.S. Application Data

(60) Provisional application No. 61/460,215, filed on Dec. 28, 2010.

(51) Int. Cl.
*F41B 5/22* (2006.01)

(52) U.S. Cl.
USPC ..... 124/44.5

(58) Field of Classification Search
USPC ..... 124/24.1, 44.5
See application file for complete search history.

(56) References Cited

U.S. PATENT DOCUMENTS

| | | | | |
|---|---|---|---|---|
| 5,490,491 | A | 2/1996 | Troncoso | |
| 5,632,263 | A | 5/1997 | Sartain | |
| 5,722,381 | A | 3/1998 | Mizek | |
| 6,044,832 | A | 4/2000 | Piersons, Jr. | |
| 6,178,959 | B1 * | 1/2001 | Troncoso et al. | 124/44.5 |
| 6,202,635 | B1 | 3/2001 | Evans | |
| 6,334,349 | B1 | 1/2002 | Rolf | |
| 6,615,813 | B1 | 9/2003 | Troncoso | |
| 6,915,791 | B2 | 7/2005 | Harwath | |
| 7,331,338 | B2 | 2/2008 | Mizek | |
| 7,409,950 | B2 | 8/2008 | Ellig | |
| 7,681,566 | B2 | 3/2010 | Mertens | |
| 7,717,103 | B2 | 5/2010 | Johnson | |
| 2008/0236556 | A1 * | 10/2008 | Sims et al. | 124/24.1 |

* cited by examiner

*Primary Examiner* — John Ricci
(74) *Attorney, Agent, or Firm* — Emery L. Tracy

(57) ABSTRACT

An archery rest system comprises a body mounted to the bow. A shaft is mounted within the body and a lever arm is secured to the shaft. An opening is formed in the body with an arrow launcher mounted to the shaft and extending through the opening. A spring biases the arrow launcher in an up position. A cord is secured to the lever arm. A securing mechanism secures the cord to the bow and an in-line dampening spring is mounted between the lever arm and the securing mechanism. With the bow at rest, the launcher moves to a down position out of contact with the arrow. Upon bow draw, the launcher moves into the up position contacting the arrow. Upon bow firing, the launcher moves to the down position with the spring absorbing load imparted on the cord when the shaft reaches a rotation travel limit.

20 Claims, 16 Drawing Sheets

ARCHERY REST SYSTEM

The present application is a continuation of provisional patent application Ser. No. 61/460,215, filed on Dec. 28, 2010, entitled "Archery Rest".

BACKGROUND OF THE INVENTION

1. Field of the Invention

This invention relates generally to an archery rest system and, more particularly, the invention relates to an archery rest system providing three styles of rest including a fall away, limb actuated, and fixed launcher position rest and allowing for assessing the bows sight for third axis alignment (reference U.S. Pat. No. 7,975,391).

2. Description of the Prior Art

Archers have always looked for ways to further increase the accuracy of the archery system (bow, arrows, string, arrow rest, sight aides, stabilizers and operator). Specific to arrow rests, arrow fletching clearance has been an area that introduces arrow flight imbalances if the fletchings of the arrow come in contact with the arrow rest launcher or any bow structure like the riser or string/cables. The conventional fall away rest eliminated this problem as does the limb actuated rest. These styles of rests are used both for how hunting and target archery.

One of the main problems with limb actuated designs is the stress that is placed on the attachment string and the forces imparted on the mechanism that stops the launcher's travel. These issues cause several problems: 1) The string stretches causing the tune of the arrow rest to change the arrow's point of impact; 2) the string breaks after repeated cycles as there is no means for absorbing the force imparted by the limb and 3) the lack of force absorption causes high mechanical stresses causing failures and worn parts.

The fixed launcher position rest is most commonly used by specialized target archers for its simple design, approach and reliability. The fixed launcher position rest, however, makes no attempt to change the position of the launcher as the launcher is always fixed in the UP position.

If an archer wants to experiment with which type of rest best works for their application (bow hunting, target, or field archery), they are required to purchase all three styles of archery rests. Therefore there exists a need to combine these three styles into archery rest providing multiple configurations for archers.

Also, there are many archery rests on the market but none integrate any features that allow the archer's sight to be assessed for third axis adjustment at full draw.

SUMMARY

The present invention is an archery rest system for use with a bow. The bow has a bow riser having a first end and a second end. A first limb is secured to the first end of the bow riser, a second limb is secured to the second end of the bow riser, and a buss cable is secured between the first eccentric limb and the second limb. An arrow is positionable within the bow with the arrow having fletchings. The archery rest system comprises a main body having a first end and a second end. Mounting means releasably mount the main body to the bow riser. A shaft is rotatably mounted within the main body with the shaft having a first end and a second end and the first end of the shaft extending beyond the first end of the main body. A lever arm is secured to the first end of the shaft. An opening is formed in the main body. An arrow launcher is mounted to the shaft and extending through the opening. Spring means biases the arrow shaft into an up launcher position. An attachment cord having a first end and a second end is provided with the first end of the attachment cord secured to the lever arm. Securing means releasably secures the second end of the attachment cord to either the first limb or the second limb. An in-line dampening spring is mounted between the lever arm and the securing means. Upon the bow being at rest, the limbs overcome the bias of the spring means to move the arrow launcher to a down position out of contact with the arrow. Upon the bow being drawn, the movement of the limbs relieves the force on the spring means and with the spring means lifting the arrow launcher back into the up position contacting the arrow. Upon the bow being fired, the movement of the limbs once again overcomes the bias of the spring means to move the arrow launcher to the down position out of any contact with the fletchings with the dampening spring absorbing load imparted on the attachment cord when the rotating shaft reaches a rotation travel limit.

The present invention further includes a method for constructing an archery rest system for use with a bow. The bow has a bow riser having a first end and a second end. A first limb is secured to the first end of the bow riser, a second limb is secured to the second end of the bow riser, and a buss cable is secured between the first limb and the second limb. An arrow is positionable within the bow with the arrow having fletchings. The method comprises providing a main body having a first end and a second end, releasably mounting the main body to the bow riser, rotatably mounting a shaft within the main body with the shaft having a first end and a second end, extending the first end of the shaft beyond the first end of the main body, biasing the shaft in a predetermined direction, securing a lever arm to the first end of the shaft, forming an opening in the main body, mounting an arrow launcher to the shaft, extending the arrow launcher through the opening, providing an attachment cord having a first end and a second, securing the first end of the attachment cord to the lever arm, securing a the second end of the attachment cord to either the first limb or the second limb, mounting an in-line dampening spring between the lever arm and either the first limb or the second limb, putting the how being at rest, overcoming the bias in the shaft to move the arrow launcher in a down position out of contact with the arrow, drawing the bow, relieving the force on the spring means, lifting the arrow launcher into an up position contacting the arrow, firing the bow, moving the arrow launcher to the down position out of any contact with the fletchings, and absorbing load imparted on the attachment cord when the rotating shaft reaches a rotation travel limit.

Figure 4A:
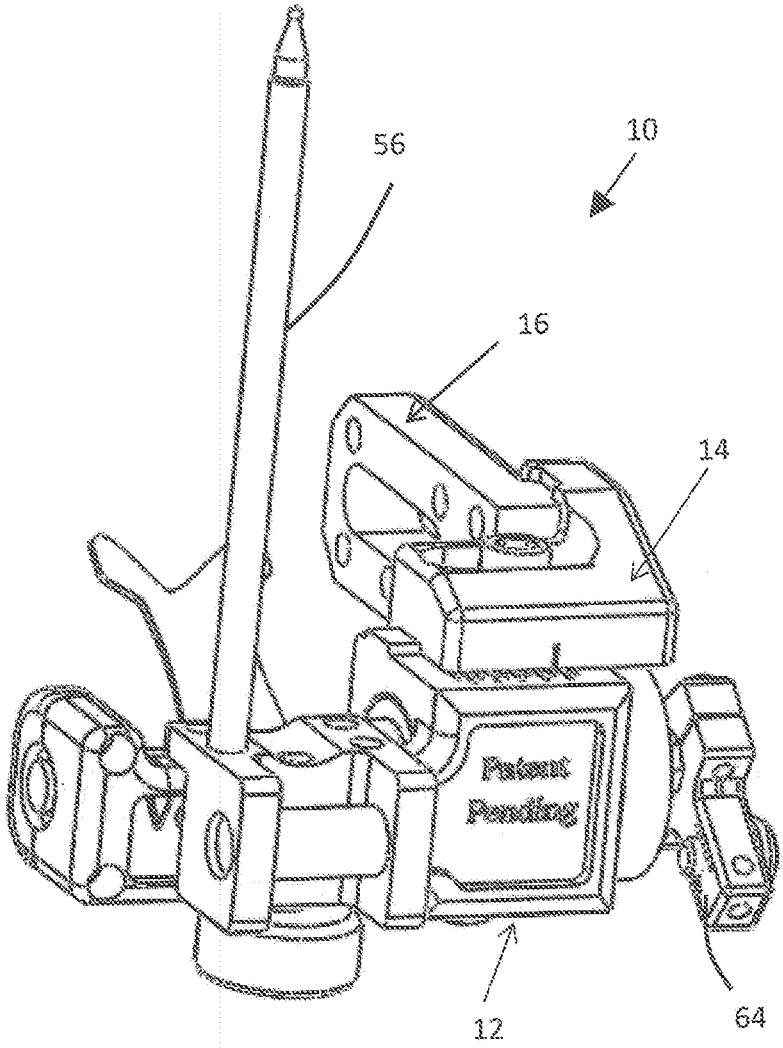
Figure 4B:
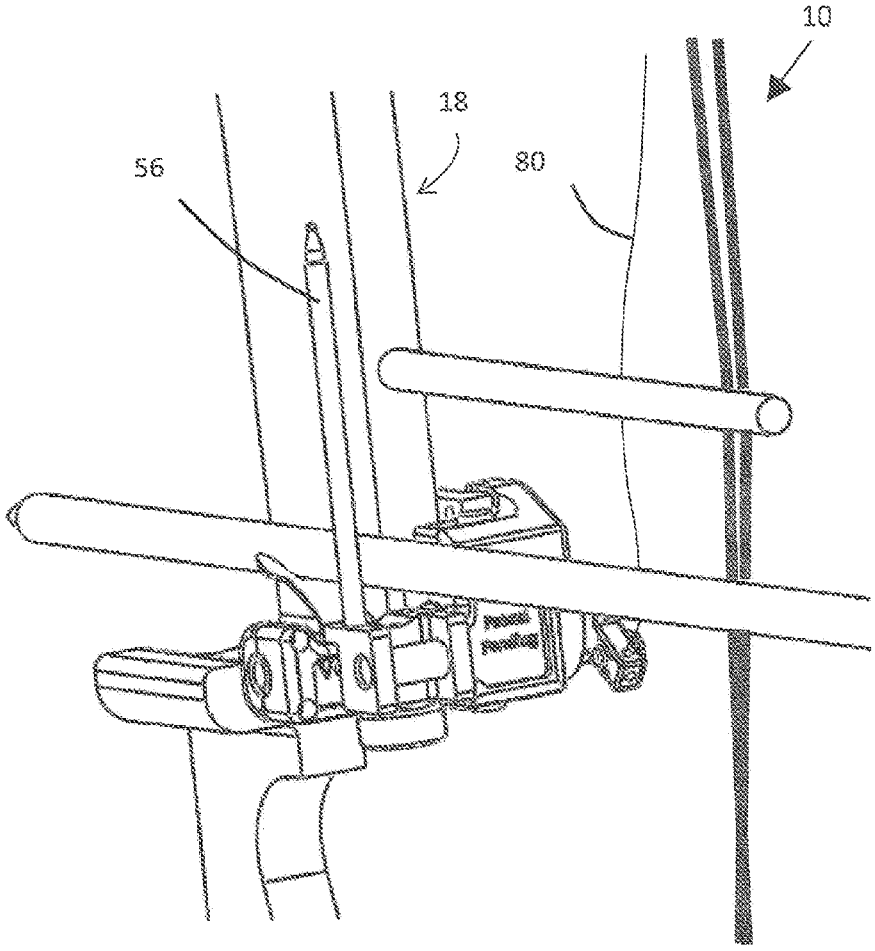
Figure 5:
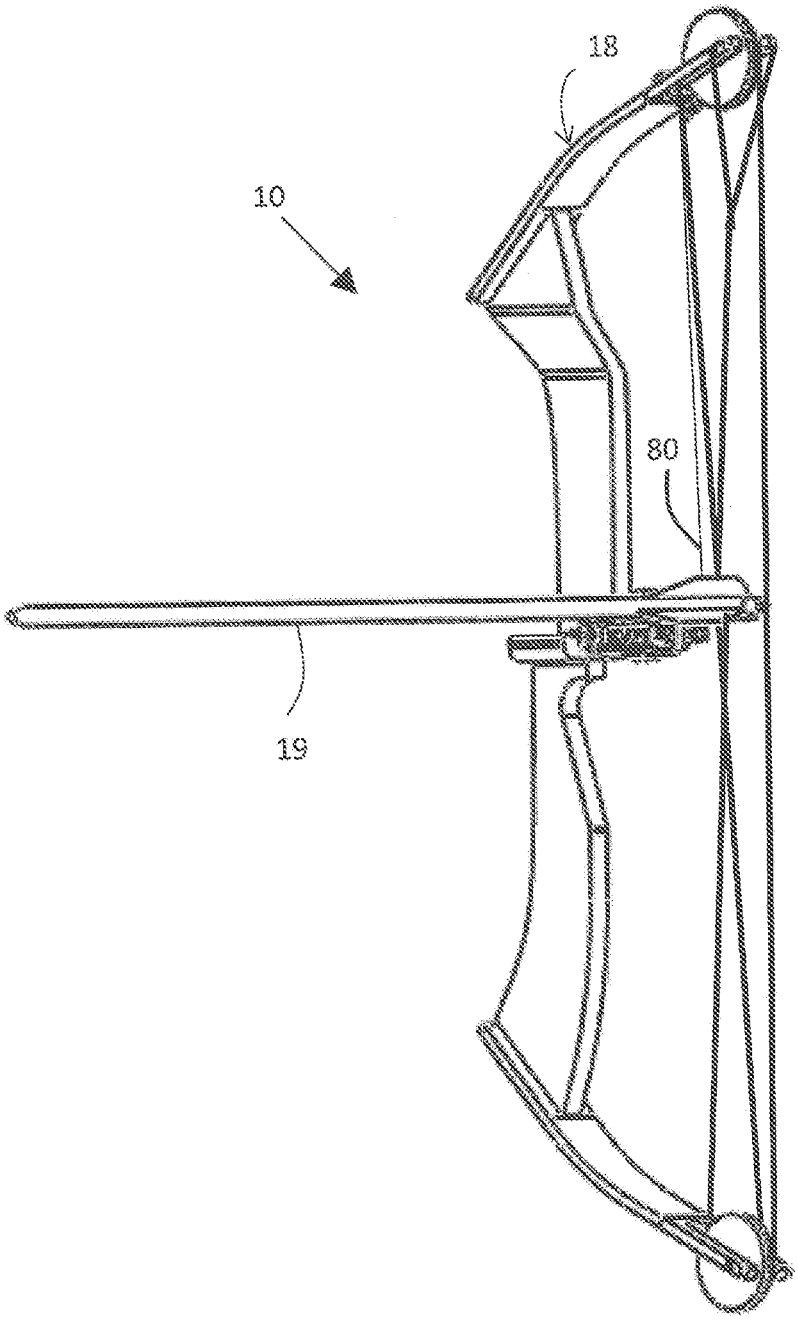
Figure 6:
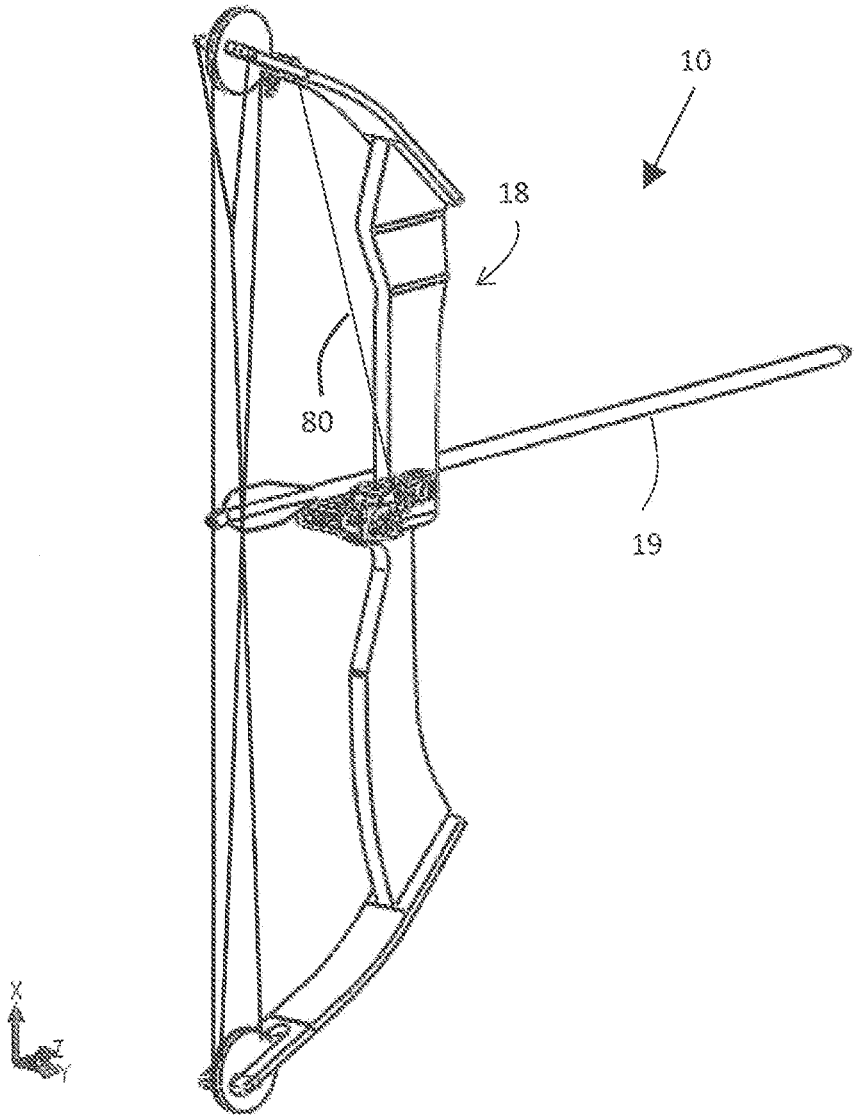
Figure 7:
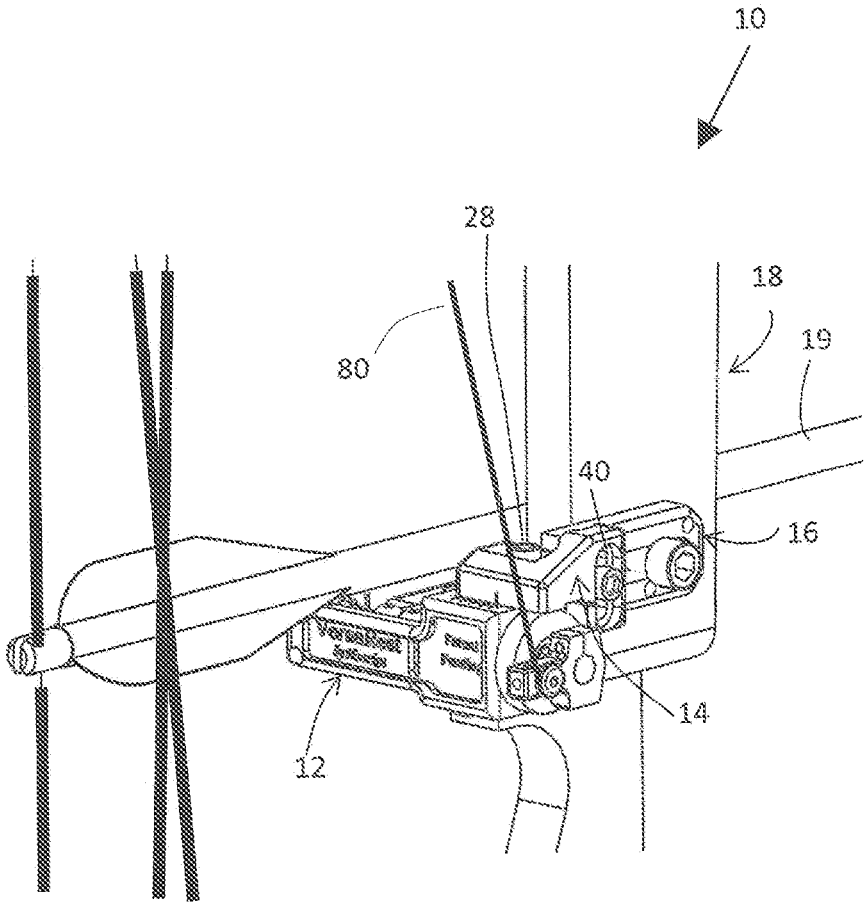
Figure 8A:
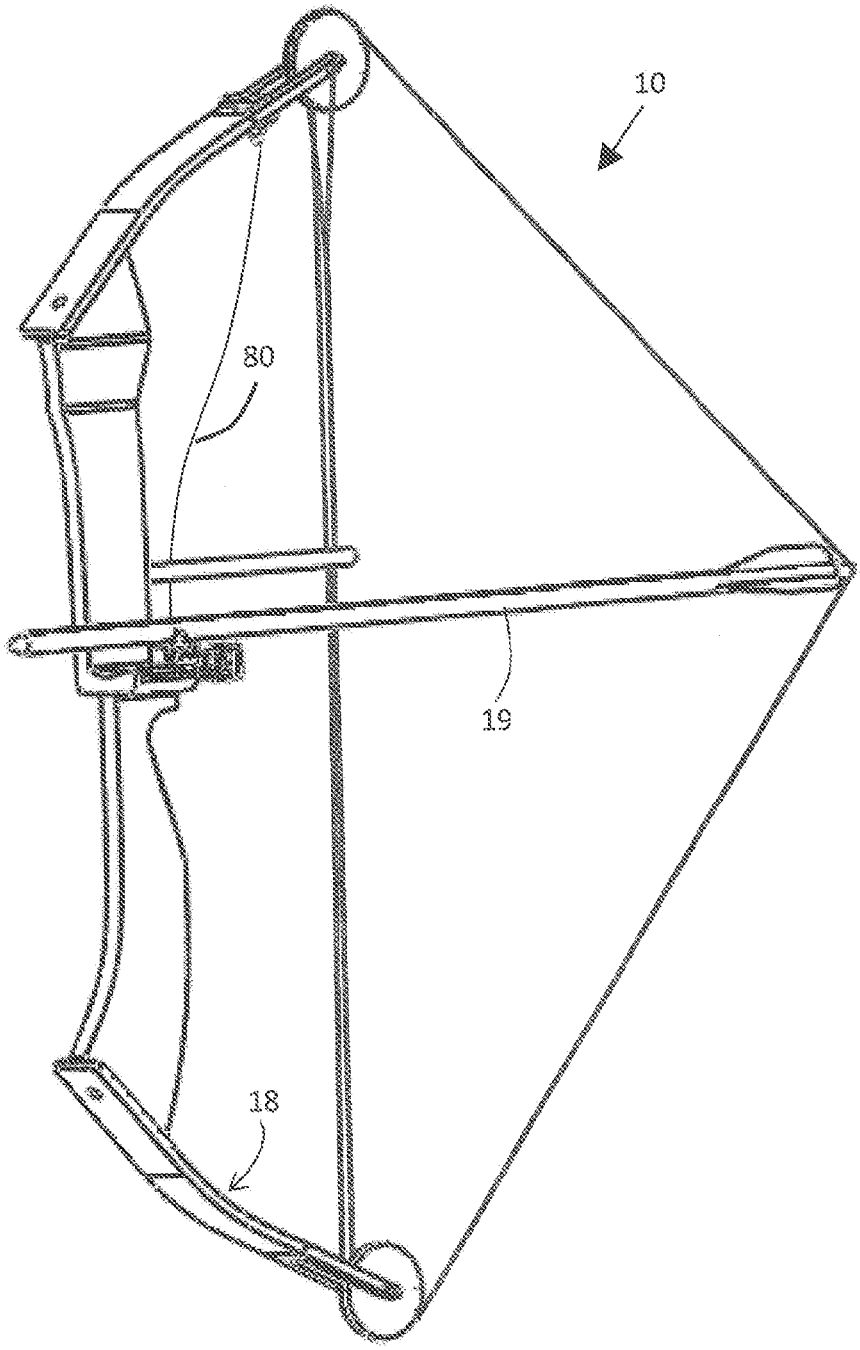
Figure 8B:
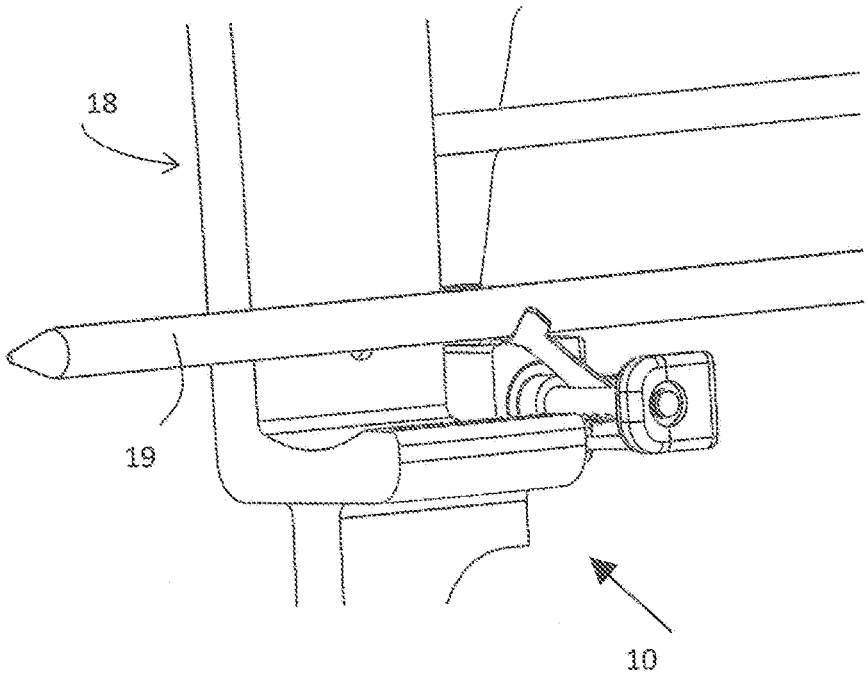
Figure 9:
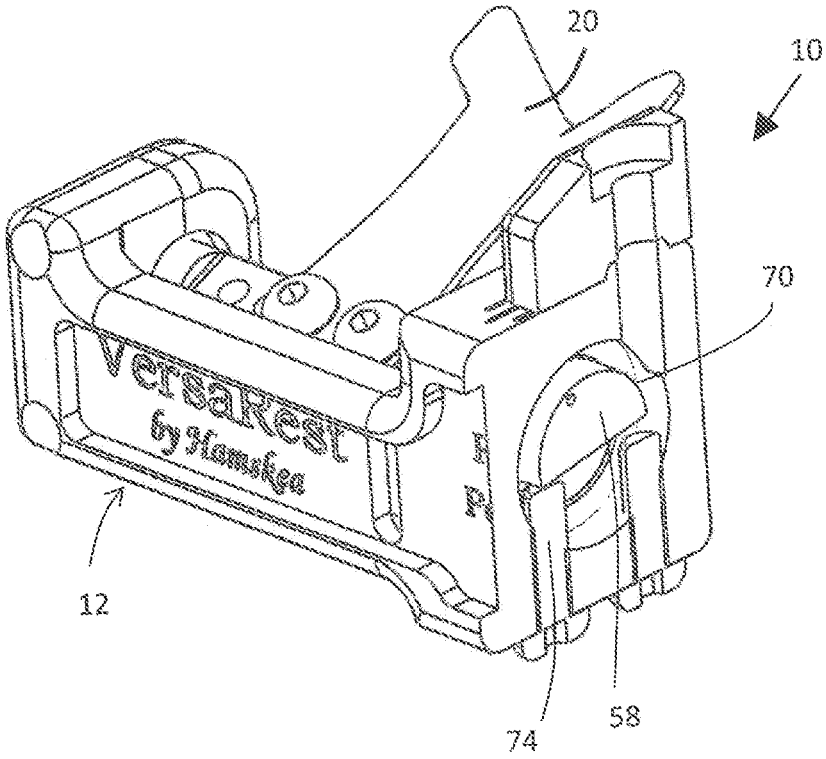
Figure 10:
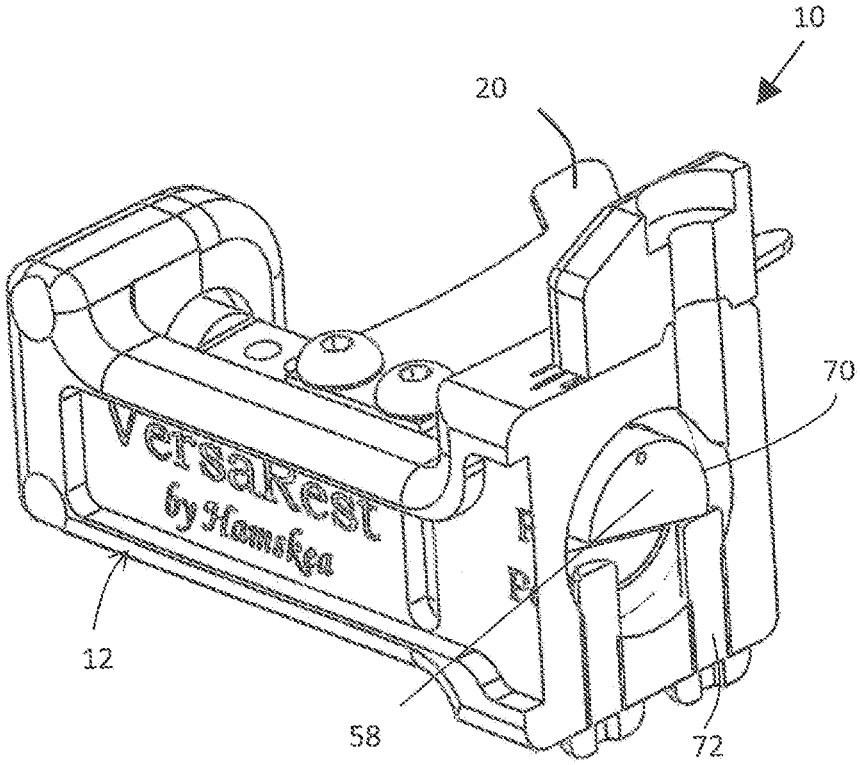
Figure 11:
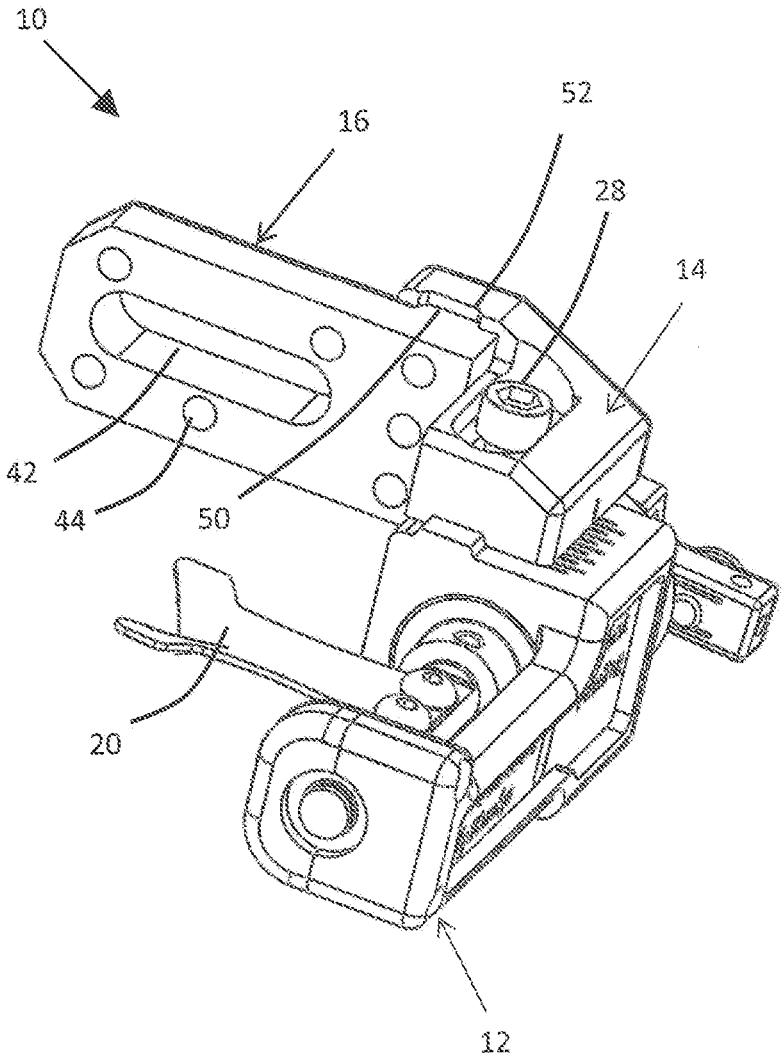
Figure 12:
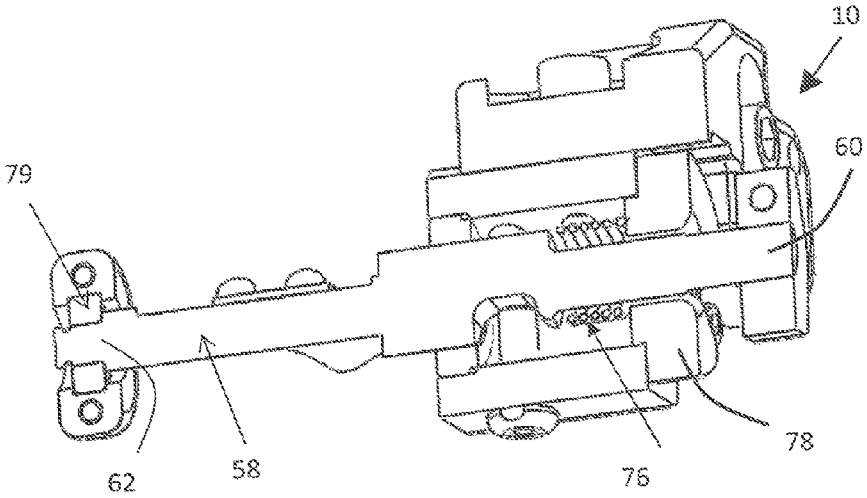
Figure 13:
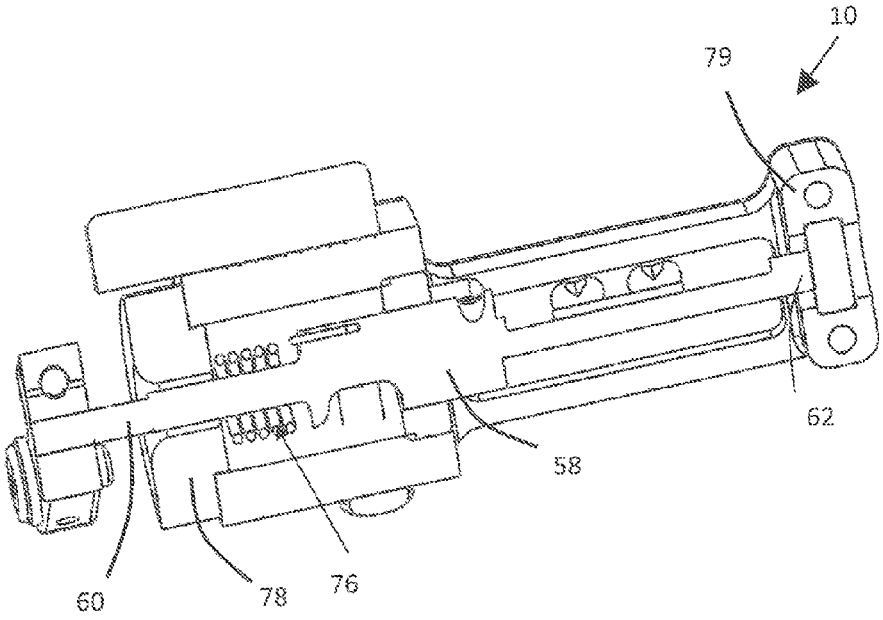
Figure 14:
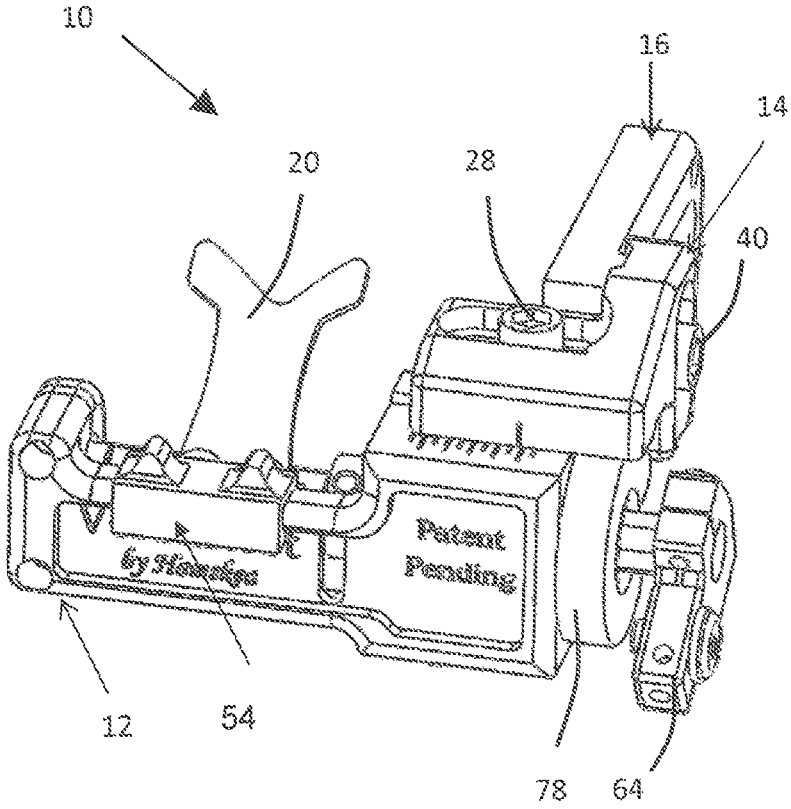
Figure 15:
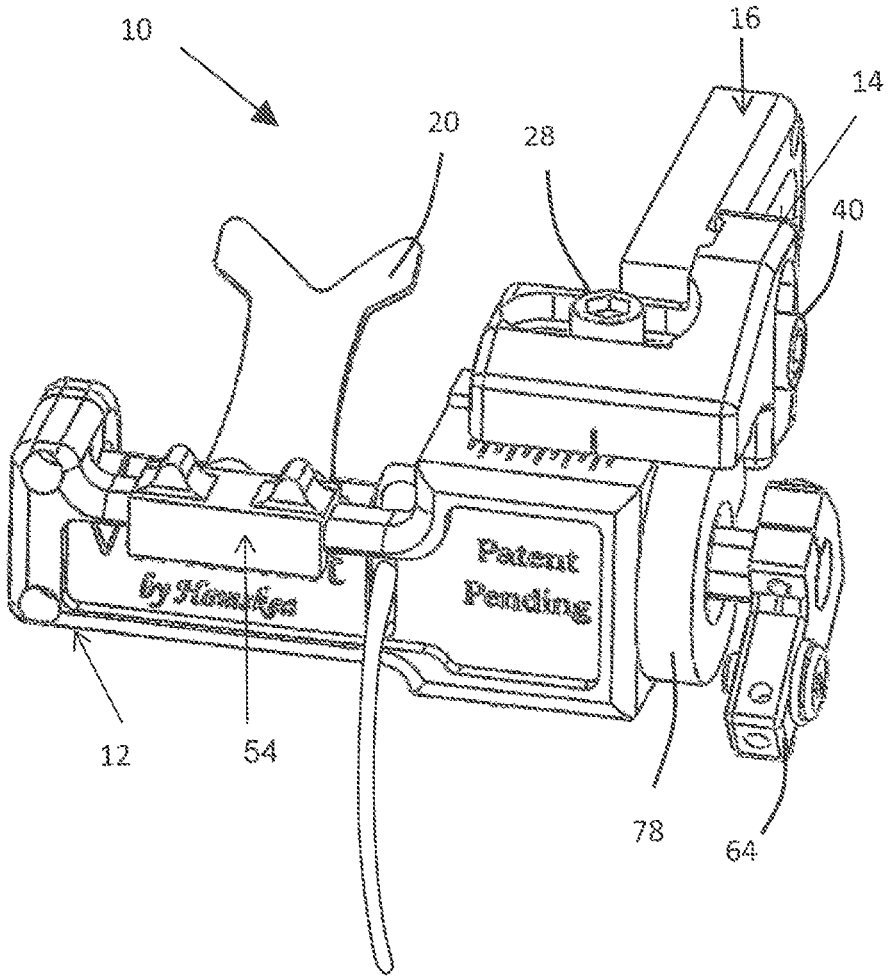

FIG. **4*a*** is a perspective view illustrating the archery rest system, constructed in accordance with the present invention, with the archery rest system having third axis leveling assessment features;

FIG. 4*b* is a perspective view illustrating the archery rest system, constructed in accordance with the present invention, with the archery rest system having third axis leveling assessment features and bow being at full draw;

FIG. 5 is a perspective view illustrating the archery rest system, constructed in accordance with the present invention, in the limb actuated configuration with the bow being at rest and the attachment cord being taut;

FIG. 6 is another perspective view illustrating the archery rest system, constructed in accordance with the present invention, in the limb actuated configuration with the bow being at rest and the attachment cord being taut;

FIG. 7 is a perspective view illustrating the archery rest system, constructed in accordance with the present invention, in the limb actuated configuration with the bow being at rest and the attachment cord being taut;

FIGS. 8*a* and 8*b* are perspective views illustrating the archery rest system, constructed in accordance with the present invention, in the limb actuated configuration with the bow being at full draw and the attachment cord being loose;

FIG. 9 is a sectional perspective view illustrating the archery rest system in an UP configuration, constructed in accordance with the present invention, with a rear screw interfacing with a feature formed on the shaft for setting a repeatable arrow launcher up angle with adjustable stack washers;

FIG. 10 is a sectional perspective view illustrating the archery rest system in a DOWN configuration, constructed in accordance with the present invention, with a forward screw interfacing with the feature formed on the shaft to set the repeatable arrow launcher up angle with adjustable stack washers;

FIG. 11 is a perspective view illustrating the archery rest system, constructed in accordance with the present invention;

FIG. 12 is a sectional perspective view illustrating the archery rest system, constructed in accordance with the present invention, with the preferred positioning of the hearings and the torsion spring;

FIG. 13 is another sectional perspective view illustrating the archery rest system, constructed in accordance with the present invention, with the preferred positioning of the bearings and the torsion spring;

FIG. 14 is a perspective view illustrating the archery rest system, constructed in accordance with the present invention, with the arrow guide slidably mounted to the main body; and FIG. 15 is another perspective view illustrating the archery rest system, constructed in accordance with the present invention, with the arrow guide slidably mounted to the main body.

DETAILED DESCRIPTION OF THE PREFERRED EMBODIMENTS

As illustrated in FIGS. 1-15, the present invention is an archery rest system, indicated generally at 10, providing three styles of rest including a fall away (FIG. 1), limb actuated (FIG. 2), and fixed launcher position (FIG. 3) rest and allowing for assessing the bows sight for third axis alignment. The archery rest system 10 of the present invention provides a means to configure one main assembly arrow rest system 10 into either a fall away, limb actuated or fixed launcher configuration.

The archery rest system 10 of the present invention comprises a main body 12, an attachment piece 14 slidably secured to the main body 12, an attachment arm 16 slidably secured to the attachment piece 14 for attaching the archery rest system 10 to a bow 18, and an arrow launcher 20. The main body 12 has a first end 22 and a second end 24 with the attachment piece 14 slidably connected adjacent the first end 22 of the main body 12. The attachment piece 14 has a first slot 26 with a first tightenable screw 28 insertable through the first slot 26 into a threaded aperture in the first end 22 of the main body 12. As the first tightenable screw 28 is loosened, the attachment piece 14 is slidable along the main body 12 to a desired point. When the desired point is reached, the first tightenable screw 28 is tightened thereby releasably securing the attachment piece 14 to the main body 12 in the desired location. A first set line 30 on the attachment piece 14 and a line of set marks 32 on the main body 12 can be provided and are alignable allowing the user to record the correct position and accurately reset the attachment piece 14 relative to the main body 12 to the desired position.

The attachment arm 16 of the archery rest 10 of the present invention has a first end 34 and a second end 36 with the first end 34 of the attachment arm 16 slidably securable to the attachment piece 14 such that the attachment arm 16 is perpendicular to the main body 12. The attachment piece 14 has a second slot 38, substantially perpendicular to the first slot 28, with a second tightenable screw 40 insertable through the second slot 38 into a threaded aperture in the first end 34 of the attachment arm 16. As the second tightenable screw 40 is loosened, the attachment arm 16 is slidable along the attachment piece 14 to a desired point. When the desired point is reached, the second tightenable screw 40 is tightened thereby releasably securing the attachment arm 16 to the attachment piece 14 in the desired location. A second set line (not shown) on the attachment piece 14 and a line of set marks (not shown) on the attachment arm 16 can be provided and are alignable allowing the user to record the correct position and accurately reset the attachment arm 16 relative to the attachment piece 14 to the desired position.

A consideration in the actual positioning of the attachment piece 14 of the archery rest system 10 of the present invention relative to the main body 12 and the actual positioning of the attachment arm 16 relative to the attachment piece 14 is the position where the archery rest system 10 is mountable to the bow 18 without interfering with bow operation. The desired point can be determined by the size, make, and design of the bow 18 being used, as well as other considerations important to the user.

The attachment arm 16 of the archery rest system 10 of the present invention has at least one bow mounting slot 42 and at least one aperture 44 for mounting the archery rest system 10 to the bow 18. As known by those persons skilled in the art, the actual number of bow mounting slots 42 and apertures 44 is a function of the type of bow 18 and desires of the manufacturer and user.

In an embodiment of the present invention, the main body 12 of the archery rest system 10 of the present invention has a first ridge 46 slidably receivable within a first recess 48 on the attachment piece 14 and the attachment arm 16 has a second ridge 50 slidably receivable within a second recess 52 on the attachment piece 14. The cooperation between the first ridge 46 and the first recess 48 and the cooperation between the second ridge 50 and the second recess 52 limit the movement of the attachment piece 14 relative to the main body 12 and the attachment arm 16 to the attachment piece 14, respectively, to a straight linear movement only.

Preferably, the main body 12 of the archery rest system 10 of the present invention is constructed from a single piece of precision machined aluminum material although constructing the main body 12 from multiple pieces and other materials is within the scope of the present invention. In addition, the attachment piece 14 is preferably constructed from a single piece of precision machined aluminum material although constructing the attachment piece 14 from multiple pieces and other materials is within the scope of the present invention. Furthermore, the attachment arm 16 is preferably constructed from a single piece of precision machined aluminum material although constructing the attachment arm 16 from multiple pieces and other materials is within the scope of the present invention.

In a preferred embodiment, the surfaces of the main body 12 of the archery rest system 10 of the present invention are either parallel or orthogonal to one another as a matter of design and construction. In addition, the surfaces of the attachment piece 14 are preferably either parallel or orthogonal to one another as a matter of design and construction. Furthermore, the surfaces of the attachment arm 16 are preferably either parallel or orthogonal to one another as a matter of design and construction. When the attachment piece 14 is secured to the main body 12 and the attachment arm 16 is secured to the attachment piece 14, the surfaces of the main body 12, the attachment piece 14, and the attachment arm 16 are either parallel or orthogonal to any other surface on the main body 12, attachment piece 14, and attachment arm 16.

In an embodiment of the present invention, the main body of the archery rest system 10 of the present invention has a threaded hole formed in the second end 24 of the main body 12. The threaded hole allows for installation of an alignment pin 56 enabling the archery rest system 10 to be used in assessing the bow systems sight for third axis alignment, as set forth in U.S. Pat. No. 7,975,391 which is hereby herein incorporated by reference. Or, as best illustrated in FIGS. 4*a* and 4*b*, the bow sight with alignment pin 56 can be clamped to the main body 12 behind the window. It should be noted that it is within the scope of the present invention to not only utilize an insertable alignment pin 56, but to in fact use any type of third axis alignment with the archery rest system 10 of the present invention.

In addition, archery rest system 10 of the present invention includes a rotatable shaft 58 having a first end 60 and a second end 62. The first end 60 of the shaft 58 extends beyond the first end 22 of the main body 12 with a lever arm 64 secured to the first end 6 of the shaft 58. Preferably, at least the first end 60 of the shaft 58 is multi-sided and the lever arm 64 has a corresponding multi-sided C-clamp tightenable about the first end 60 of the shaft 58. In a preferred embodiment, at least the first end 60 of the shaft 58 is actually an eight-sided shaft mating with the eight-sided C-clamp of the lever arm 64 enabling the position of the lever arm 64 relative to the shaft 58 to assume up to eight different configurations. The eight-sided first end 60 of the shaft 58 and C-clamp of the lever arm 64 also allows for repeatable mounting and dismounting of the lever arm 64 to the first end 60 of the shaft 58 and results in a no-slip mounting engagement between the shaft 58 and the lever arm 64.

The main body 12 of the archery rest system 10 of the present invention further includes a window 66 formed between the attachment piece 14 and the second end 24 of the main body 12. Within the window 66, the arrow launcher 20 is mounted to the shaft 58. The shaft 58 includes multiple mounting holes 68 on which to mount the arrow launcher 20. The multiple mounting holes 68 enable left and right position of the arrow launcher 20 relative to the main body 12 and the shaft 58 depending on the desires of the user. Preferably, the arrow launcher 20 is of a wide (a.k.a. "whale tail") design enabling the arrow launcher 20 to pick up the arrow 19 as the arrow 19 can be positioned in numerous positions left to right within the window 66.

As best illustrated in FIGS. 14 and 15, preferably, the archery rest system 10 of the present invention has the arrow guide 54 slidable along the window 66 of the main body 12 to align with the position of the arrow launcher 20 when the arrow launcher 20 is in the DOWN position. The main body 12 preferably has I-beam configuration with the arrow guide 54 grasping the I-beam and adjustable left or right to guide the arrow 19 received by the arrow launcher 20 depending on the desires of the user. In addition, preferably the arrow guide 54 is made from a rubber material to ensure less noise from arrow 19 contact.

As best illustrated in FIGS. 9 and 10, the shaft 58 of the archery rest system 10 of the present invention further includes a feature 70 having a first stop surface and a second stop surface. To limit the extent of rotation of the shaft 58 within the main body 12, two position screws located at the first end 22 of the main body 12 extend through the main body 12 to engage the stop surfaces on the feature 70 of the rotating shaft 58. The first position screw 72 is contactable with the first stop surface and sets the DOWN position/angle of the arrow launcher 20. Adding or subtracting stack washers results in changing height of the first position screw 72. The second position screw 74 is contactable with the second stop surface and sets the UP position of the arrow launcher 20 with adding or subtracting stack washers resulting in changing height of the second position screw 74. Adding washers causes the arrow launcher angle to become more acute. Less washers results in an obtuse arrow launcher angle. By counting the stack washers, the angles become repeatable allowing the user to repeat his or her desired arrow launcher angle.

As best illustrated in FIGS. 11-13, the archery rest system 10 of the present invention uses both left and right hand torsion springs 76 for coupling the force between the rotating shaft 58 and the fixed main body 12. To configure the archery rest system 10 for either the fall away mode or the limb actuated mode, either the left hand torsion spring or the right hand torsion spring is mounted within the main body 12 and cooperates with the shaft 58. Both of the torsion springs 76 are preferably an open coil design eliminating coil-to-coil contact and ensuring no additional friction in the torsion spring allowing for the smoothest of action inherent of the two ball bearings of the archery rest system 10. A knurled knob 78 locates the torsion spring 76 to the rotating shaft 58 and has two mounting screw locations that mate with six screw locations on the main body 12 of the archery rest system 10 resulting in up to twelve spring tension settings for one revolution) (360° of the knob 78 allowing the archer to set the arrow launcher/shaft spring rate for maximum tenability. The end cap at the second end 24 of the main body 12 is preferably secured with screws, i.e., two (2) 4-40 screws, and captures the outer ball bearing assembly 79 with an interference fit to eliminate all left to right play in the archery rest system 10. This design eliminates cantilevering of the arrow shaft which exposes the shaft to the possibilities of being bent or damaged from external forces. Cantilevered designs also magnify the errors or bearing wear as the error is linearly proportional to the wear error. With the archery rest system 10 of the present invention, the arrow rest shaft is supported from outer bearing mating surface to the inner bearing mating surface.

The archery rest system 10 of the present invention further includes a limb assembly having an attachment cord 80 or cable having a first end and a second end and a securing mechanism 82. The first end of the attachment cord 80 is secured to the lever arm 64 and the securing mechanism 80 secures the second end of the attachment cord 80 to the bow 18. The securing mechanism 80 can be a limb clamp securable to the bow 18 by clamping directly to the bow 18 or can be any other way or manner of securing the second end of the attachment cord 80. The limb assembly couples the force of the bow's limbs to the lever arm 64 thereby using the impulse force function of the limb upon release of the bow string to pull on the attachment cord 80 that applies the force to the lever arm 64 thereby rotating the shaft 58 and the arrow launcher 20.

The limb assembly of the archery rest system 10 of the present invention includes an inline buffering/dampening spring 84 mounted between the lever arm 64 and the bow 18. In a preferred embodiment, the dampening spring 84 is mounted between the second end of the attachment cord 80 and the limb clamp 82 although mounting the dampening spring 84 elsewhere including at the first end of the attachment cord 80 or within the attachment cord 80 is within the scope of the present invention. The dampening spring 84 provides compliance as the shaft 58 stops its rotation travel when it contacts the first position screw 72 while the bow limb overextends past its natural resting position. This compliance is a key component in ensuring a quiet and reliable arrow rest. Without the dampening spring 84, the sudden interference between the shaft 80 and the first position screw 72 causes the shaft 58 to rotate in the opposite direction; also known as launcher bounce or flutter. Launcher bounce or flutter causes the arrow launcher 20 to bounce back in the path of the traveling arrow 19 causing unwanted contact with the arrow 19 or the arrow fletchings. The dampening spring 84 is preferably of an open coil design to eliminate any coil-to-coil interference that may cause unnecessary noise.

When attaching the attachment cord 80 of the archery rest system 10 of the present invention directly to the buss cable, the dampening spring 84 can be included, but is typically not needed since the buss cables have an inherent spring/compliance. The attachment cord 80 can be attached (without the inline dampening spring) to the bow cables by one of several methods. The bow 18 can be put in a press relieving the tension. Then, the strands of the cable are separated (cables are typically constructed of 20-24 individual strands of string material). Next, the attachment cord 80 is threaded through the cable, the bow 18 is drawn back, and then let down. The location of the attachment cord 80 is marked, cut to length, and "burn" (fray the end and burn it with a lighter or the like making a small ball at the end that prevents the attachment cord 80 from pulling through the cable) the attachment cord 80.

The archery rest system 10 also makes use of at least two attachment points (thru-hole in rotating shaft 58 and external lever arm 64) for the fall away configuration (FIG. 1) and a multi-repeatable configurable external lever arm 54 for the limb (top or bottom limb) actuated configuration (FIG. 2) with an in-line dampener spring 84. Furthermore, the archery rest system 10 allows for the fixed (FIG. 3) launcher blade position by making use of the torsion springs 76 for holding the arrow launcher 20 in the UP position.

Figure 1:
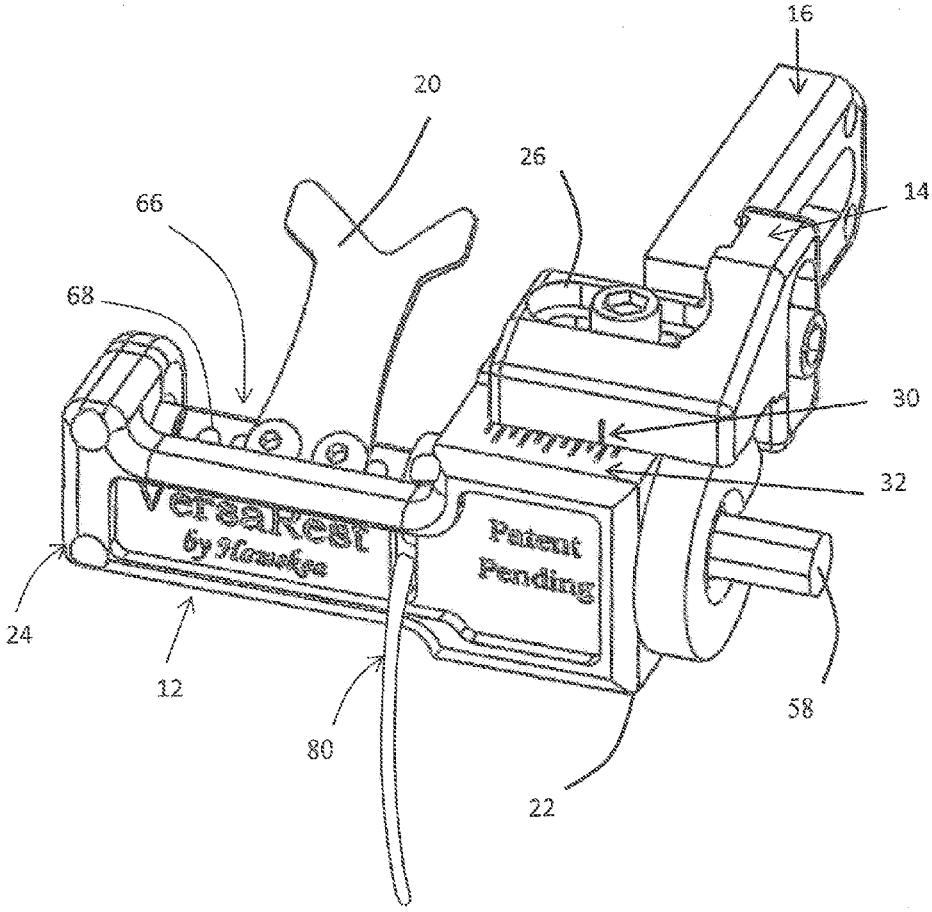
FIG. 1 is a perspective view illustrating an archery rest system, constructed in accordance with the present invention, with the archery rest system being in the fall away configuration.
Figure 2:
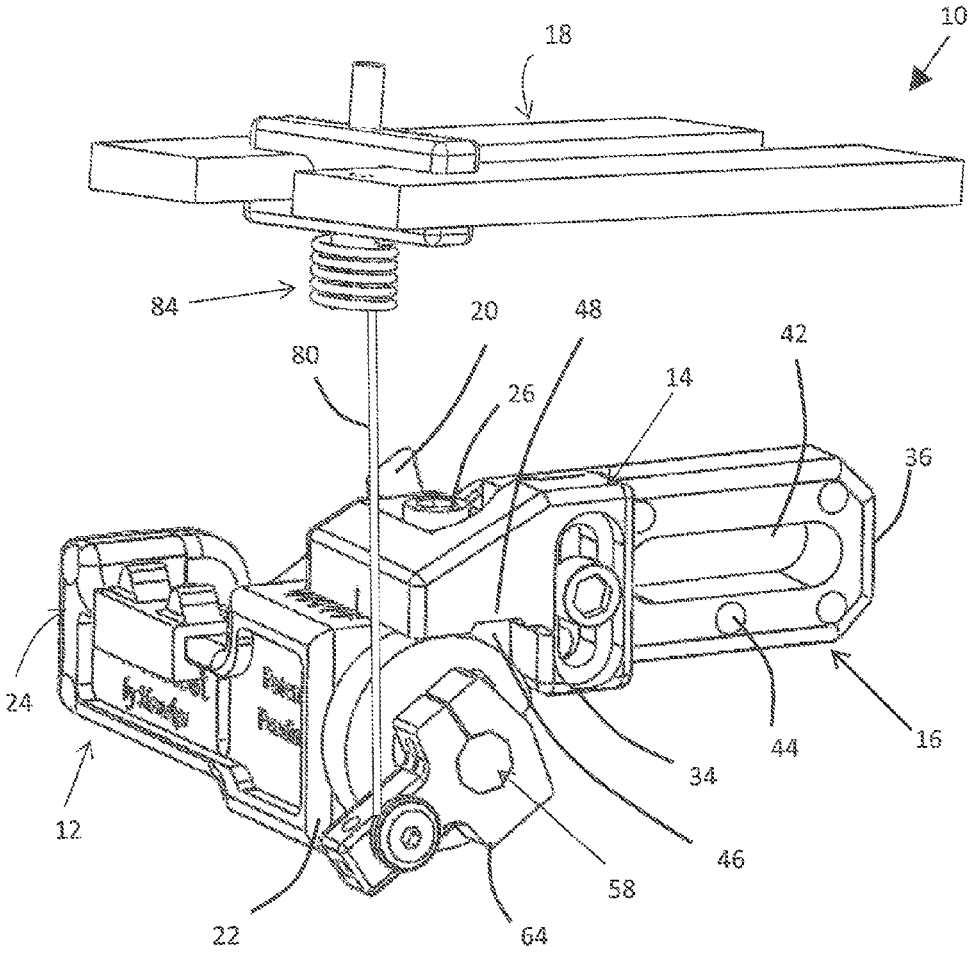
FIG. 2 is a perspective view illustrating the archery rest system, constructed in accordance with the present invention, with the archery rest system being in the limb actuated configuration with an integral in-line dampener.

FIG. 1 illustrates the fall away configuration of the archery rest system 10 of the present invention where the attachment cord 80 is attached to the lever arm 64 or the shaft 58 mounted about the first end 60 of the rotating shaft 58. The attachment cord 80 can be attached to the dampening spring 84 which is then attached to the bow's buss cable which, once the bow 18 is drawn into position, the buss cable exerts a down force overcoming the torsion spring 76 and lifting the arrow launcher 20 into the UP position. The position of the arrow launcher 20 is set by the first and second position screws 72, 74 mounted through the main body 12 and contacting the features 70 on the rotating shaft 58 creating a mechanical stop. Once the bow 18 is fired, the buss cable returns to its resting position and the torsion spring 76 of the archery rest system 10 rotates the shaft 58 moving the arrow launcher 20 down and out of the way of the arrow 18. The fall away configuration can be achieved by using the slotted hole and through hole in the arrow shaft or by use of the lever arm 64 and one of the eight positions provided by the shaft 58.

FIGS. 2 and 5-8 illustrate limb actuated views of the archery rest system 10 of the present invention where the attachment cord 80 is attached via the dampening spring 84 to the limb of the bow 18 (the top limb is illustrated but can be configured for the bottom limb). With the bow 18 at rest, the limb overcomes the torsion spring 76 tension and forces the arrow launcher 20 into the down position. When the bow 18 is drawn, the limbs move toward the archery rest system 10 relieving the force on the torsion spring 76. The torsion spring 76 then allows the arrow launcher 20 to be biased into the UP position. As the bow 18 is fired, the limb (top limb in FIG. 2) moves upward (away from the arrow rest system 10) pulling on the attachment cord 80. The attachment cord 80 pulls on the lever arm 54 attached to the rotating shaft 58. When the rotating shaft 58 physically reaches its rotation travel limit (i.e. arrow launcher 20 moves downward striking a bow riser shelf or stops on the button head screw inserted from the bottom of the main body 12) with the in-line dampener spring 84 absorbing the load imparted on the attachment cord 80 mounting points by the bow limb which is still in motion.

Figure 3:
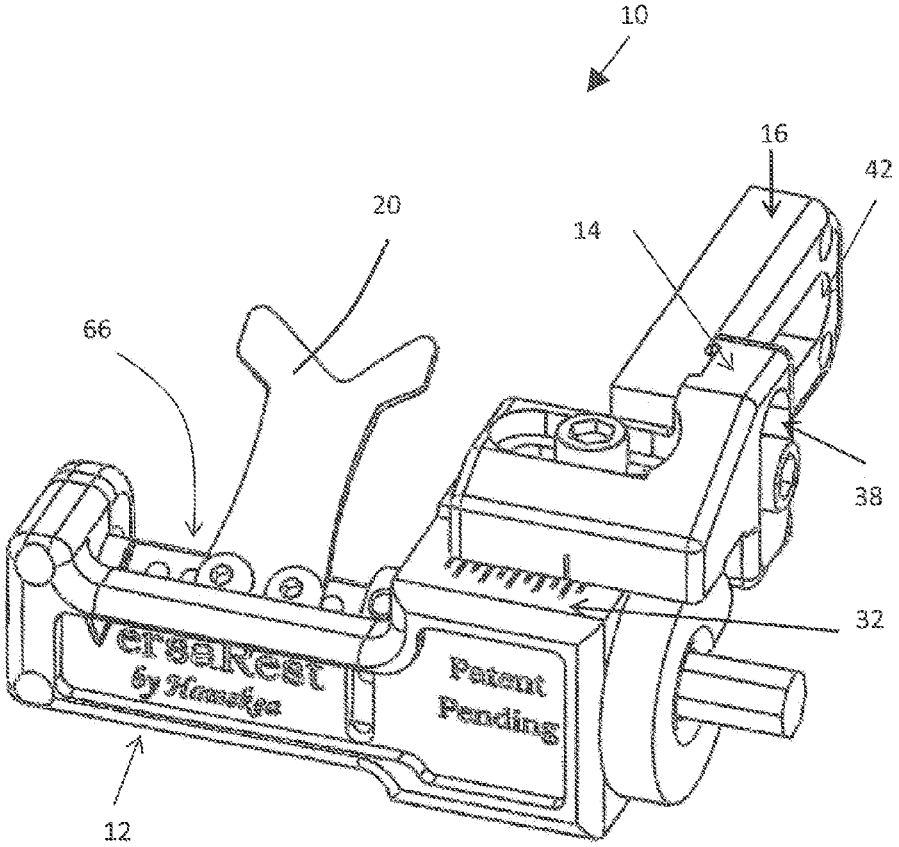
FIG. 3 is a perspective view illustrating the archery rest system, constructed in accordance with the present invention, with the archery rest system being in a fixed launcher position configuration.

FIG. 3 illustrates the archery rest system 10 of the present invention configured in the fixed launcher configuration. In this embodiment, the lever arm 54 and limb assembly is removed and the archery rest system 10. The torsion spring 76 hold the launcher in UP position and provides some compliance for the dynamics associated with the launching of an arrow.

CONCLUSION

The archery rest system 10 of the present invention comprises three (3) major types of arrow rests; fall away, limb actuated, and fixed launcher. The fall away archery rest has moving parts enabling it to fall out of the way under spring force after the bow string has been released. The advantage of this style of rest is that it rotates the arrow launcher 20 out of the way of the traveling arrow 19. i.e., it falls away. The limb actuated arrow rest relies on the force of the bow's limb to force the arrow launcher 20 to the down position as coupled through an attachment cord 80. The archery rest system 10 has a spring steel arrow launcher 20 held in either a fixed position via mechanical features or by a spring 76 applying force about the axis of rotation of the shaft 58. The advantage of the archery rest system 10 is that the position of the arrow launcher 20 is repeatable and has minimal moving parts.

Of the two mechanical actuation methods of the arrow rest system 10 of the present invention, there are two approaches in forcing the arrow launcher 20 down and out of the way the traveling arrow. One approach is to use spring tension to keep the arrow launcher 20 in the down position while the bow 18 is at rest (i.e., not at full draw). An attachment cord 80 attached to the limb assembly is attached to the buss cable of the compound bow 18. When the bow 18 is drawn, the buss cable moves in a downward direction pulling on the lever arm 64, rotating the shaft 58, and increasing the spring tension while lifting the arrow launcher 20 and the arrow 19 that sets on top of it. When the bow 18 is fired, the buss cable returns to its resting position relieving the force on the spring and enabling the spring 76 to drive the arrow launcher 20 to its resting position. This method is known as the fall-away or drop-away rest.

The second method makes use of the limb or control cable of the bow 18 to apply force through the attachment cord 80 that pulls down the arrow launcher 20 when the bow 18 is fired. This method is the opposite of the drop-away in that the spring tension on the arrow launcher 20 lifts the arrow launcher 20 up opposed to keeping it down. The attachment cord 80 is attached to the launcher assembly and the bow limb. In this position, the limb tension overcomes the arrow launcher spring tension keeping the arrow launcher 20 down. When the bow 18 is drawn, the limb moves down relieving the force of the limb from the spring 76 of the archery rest system 10 thereby raising the arrow launcher 20 and the arrow resting 19 on top of it. When the bow 18 is fired, the limb returns to its resting position which pulls on the attachment cord 80 pulling the arrow launcher 20 down. This style is known as a limb actuated rest.

The third rest style of the archery rest system 10 of the present invention uses no external forces and is fixed in its arrow launcher 20 position. It is static in nature and only the spring constant of the arrow launcher material itself provides the compliance for accommodating the dynamics of launching an arrow.

The foregoing exemplary descriptions and the illustrative preferred embodiments of the present invention have been explained in the drawings and described in detail, with varying modifications and alternative embodiments being taught. While the invention has been so shown, described and illustrated, it should he understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. An archery rest system for use with a bow, the bow having a bow riser having a first end and a second end, a first limb secured to the first end of the bow riser, a second limb secured to the second end of the bow riser, and a buss cable secured between the first limb and the second limb via eccentrics rotatably attached by axle to each limb, an arrow positionable within the bow, the arrow having fletchings, the archery rest system comprising:

a main body having a first end and a second end;

mounting means for releasably mounting the main body to the bow riser;

a shaft rotatably mounted within the main body, the shaft having a first end and a second end, the first end of the shaft extending beyond the first end of the main body;

a lever arm secured to the first end of the shaft;

a window opening formed in the main body;

an arrow launcher mounted to the shaft and extending through the window opening;

spring means for biasing the arrow launcher into an up position;

an attachment cord having a first end and a second end, the first end of the attachment cord secured to the lever arm;

securing means for releasably securing the attachment cord to either the first limb or the second limb;

an in-line dampening spring mounted between the lever arm and the securing means;

wherein upon the bow being at rest, the limbs overcome the bias of the spring means to move the arrow launcher to a down position out of contact with the arrow;

wherein upon the bow being drawn, the movement of the limbs relieves the force on the spring means and with the spring means lifting the arrow launcher back into the up position contacting the arrow; and wherein upon the bow being fired, the movement of the limbs once again overcomes the bias of the spring means to move the arrow launcher to the down position out of any contact with the fletchings, the dampening spring absorbing load imparted on the attachment cord when the rotating shaft reaches a rotation travel limit.

2. The archery rest system of claim 1 wherein the dampening spring provides compliance as the shaft stops rotation travel and the bow limbs overextend past a natural resting position.

3. The archery rest system of claim 1 wherein the mounting means comprises:

an attachment piece, the attachment piece having a first slot with a first tightenable screw insertable through the first slot into a threaded aperture in the first end of the main body, wherein as the first tightenable screw is loosened, the attachment piece is slidable along the main body to a desired point, wherein upon reaching the desired point, the first tightenable screw is tightened thereby releasably securing the attachment piece to the main body in the desired location;

an attachment having a first end and a second end, the first end slidably securable to the attachment piece such that the attachment arm is perpendicular to the main body, wherein the attachment piece has a second slot substantially perpendicular to the first slot, the second tightenable screw insertable through the second slot into a threaded aperture in the first end of the main body, wherein as the second tightenable screw is loosened, the attachment arm is slidable along the attachment piece to a desired point, wherein upon reaching the desired point, the second tightenable screw is tightened thereby releasably securing the attachment arm to the attachment piece in the desired location; and attaching means for attaching the second end of the attachment arm to the bow riser.

4. The archery rest system of claim 3 and further comprising:

a first set line on the attachment piece and a line of set marks on the main body alignable for recording a desired position:

a second set line on the attachment piece and a line of set marks on the attachment arm body alignable for recording a desired position.

5. The archery rest system of claim 3 and further comprising:

a first ridge formed on the main body;

a first recess formed in the attachment piece, the first ridge slidably receivable within the first recess;

a second ridge formed on the attachment arm;

a second recess formed in the attachment piece, the second ridge slidably receivable within the second recess;

wherein the cooperation between the ridges and the recesses limit the movement of the attachment piece relative to the main body and the attachment arm relative to the attachment piece, respectively, to a straight linear movement only.

6. The archery rest system of claim 3 wherein upon securing the attachment piece to the main body and the attachment arm to the attachment piece, all surfaces of the main body, the attachment piece, and the attachment arm are either parallel or orthogonal to any other surface on the main body, attachment piece, and attachment arm.

7. The archery rest system of claim 1 and further comprising:

a sight leveling device mounted to the main body.

8. The archery rest system of claim 1 wherein the first end of the shaft is multi-sided and the lever arm has a corresponding multi-sided C-clamp tightenable about the first end of the shaft.

9. The archery rest system of claim 1 and further comprising;

a plurality of mounting holes formed in the shaft, the arrow launcher mountable to shaft at any position along the mounting holes.

10. The archery rest system of claim 1 and further comprising:

rotation limit means for limiting the rotation of the shaft relative to the main body.

11. The archery rest system of claim 10 wherein the rotation limit means comprises:

a feature formed on the shaft, the feature having a first stop surface and a second stop surface;

a first position screw extending through the main body and contactable with the first stop surface thereby setting the DOWN position/angle of the arrow launcher; and a second position screw extending through the main body and contactable with the second stop surface thereby setting the UP position/angle of the arrow launcher.

12. The archery rest system of claim 11 wherein the height of each of the set screws is adjustable with washers to adjust the amount of rotation.

13. The archery rest system of claim 1 wherein the dampening spring is mounted between the second end of the attachment cord and the securing means.

14. The archery rest system of claim 1 and further comprising:

an arrow guide slidable along the window of the main body to align with the position of the arrow launcher.

15. The archery rest system of claim 1 wherein the securing means is a limb clamp.

16. The archery rest system of claim 1 and further comprising:

an end cap at the second end of the main body;

wherein the end cap captures outer ball bearing with an interference fit for eliminating all left to right play of the shaft in the main body and eliminating cantilevering of the arrow.

17. The archery rest system of claim 1 and further comprising adjustment means for adjusting the torsion tension in the spring means.

18. A method for constructing an archery rest system for use with a bow, the bow having a bow riser having a first end and a second end, a first limb secured to the first end of the bow riser, a second limb secured to the second end of the bow riser, and a buss cable secured between the first limb and the second limb via eccentrics rotatably attached by axle to each limb, an arrow positionable within the bow, the arrow having fletchings, the method comprising:

providing a main body having a first end and a second end;

releasably mounting the main body to the bow riser;

rotatably mounting a shaft within the main body, the shaft having a first end and a second end;

extending the first end of the shaft beyond the first end of the main body;

biasing the shaft in a predetermined direction;

securing a lever arm to the first end of the shaft;

forming a window opening in the main body;

mounting an arrow launcher to the shaft;

extending the arrow launcher through the window opening;

providing an attachment cord having a first end and a second;

securing the first end of the attachment cord to the lever arm;

securing the second end of the attachment cord to either the first limb or the second limb;

mounting an in-line dampening spring between the lever arm and either the first limb or the second limb;

putting the bow being at rest:

overcoming the bias in the shaft to move the arrow launcher in a down position out of contact with the arrow;

drawing the bow;

relieving the force on the spring means;

lifting the arrow launcher into an up position contacting the arrow;

firing the bow;

moving the arrow launcher to the down position out of any contact with the fletchings; and absorbing load imparted on the attachment cord when the rotating shaft reaches a rotation travel limit.

19. The method of claim 18 wherein the dampening spring provides compliance as the shaft stops rotation travel and the bow limbs overextend past a natural resting position.

20. The method of claim 18 and further comprising:

mounting a sight leveling device to the main body.

* * * * *